United States Patent [19]

Carella et al.

[11] Patent Number: 4,745,778

[45] Date of Patent: May 24, 1988

[54] INTEGRAL EVAPORATOR AND ACCUMULATOR FOR AIR CONDITIONING SYSTEM

[75] Inventors: Thomas J. Carella, Niagara Falls; John N. Bannan, Lockport, both of N.Y.

[73] Assignee: General Motors Corporation, Detroit, Mich.

[21] Appl. No.: 71,740

[22] Filed: Jul. 9, 1987

Related U.S. Application Data

[63] Continuation-in-part of Ser. No. 031,022, Mar. 27, 1987.

[51] Int. Cl.[4] ..... F25B 43/00

[52] U.S. Cl. ..... 62/512; 62/515

[58] Field of Search ..... 62/304, 83, 512, 513, 62/515

[56] References Cited

U.S. PATENT DOCUMENTS 3,013,404 12/1961 Endress et al. ..... 62/512

*Primary Examiner*—Henry A. Bennet

*Attorney, Agent, or Firm*—R. L. Phillips

[57] ABSTRACT

An evaporator assembly includes a housing having a fluid inlet and a fluid outlet. A heat exchange core is in direct fluid communication with the fluid inlet for interchanging heat between refrigerant and air flow over the core. An accumulator chamber is contained within the housing and is in direct fluid communication between the heat exchange core and the fluid outlet for collecting and separating vaporized and unvaporized refrigerant directly from the heat exchange core and for providing an environment of vaporized refrigerant about said fluid outlet.

1 Claim, 2 Drawing Sheets

INTEGRAL EVAPORATOR AND ACCUMULATOR FOR AIR CONDITIONING SYSTEM

This application is a continuation-in-part application of U.S. Ser. No. 031,022, filed Mar. 27, 1987.

TECHNICAL FIELD

This invention relates to heat exchange systems. More specifically, the invention relates to those portions of the heat exchange system which are generally termed the evaporator and the accumulator.

BACKGROUND ART

Air conditioning systems, such as those used in passenger cars, vans, and trucks, include a closed system for refrigerant flow. The refrigerant is circulated in a set of closed lines and components generally referred to as comprising the refrigeration cycle.

In the system, an evaporator cools, dries, and cleans the air that enters the passenger compartment. In operation, refrigerant enters the evaporator as a low pressure mixture of liquid and vapor. The liquid vaporizes at the low pressure, absorbing large quantities of heat from the passing air. As the heat is transferred through the walls of the evaporator from the air passing over it, moisture in the air condenses on the surface and is drained off, carrying dust and pollen with it.

In prior art systems, a fluid line connects the evaporator to an accumulator. The accumulator collects refrigerant liquid, separating the liquid from the vaporized refrigerant. The accumulator is a collection point for liquid, a separator of liquid and gas, and a filtration area. The accumulator may also function as a sound attenuating device.

The fluid line between the evaporator and accumulator presents a problem in that there is thermal loss from the tube, as well as from the other exposed surfaces of the assembly. For example, present automotive air conditioning systems sometimes locate the accumulator at a significant distance from the evaporator. The combination of the surface area of the accumulator, extended fluid line, and evaporator, and additional connector pipes in combination result in thermal loss and a decrease in the efficiency of the system. The extended fluid line also causes a pressure drop between the evaporator and accumulator housings.

Some prior art automotive air conditioning systems include an evaporator housed in an evaporator blower assembly. The assembly includes a plastic casing surrounding the evaporator which guides air from a blower or fan through the evaporator core. In these systems, the accumulator is outside of the evaporator blower assembly and thereby outside of the air stream flowing through the plastic casing.

In combination with the above considerations, present day automotive designs minimize the engine compartment space. Therefore, it is desirable to minimize the space requirement for the components of the air conditioning system.

Another consideration in the manufacture of air conditioning systems is the labor and manufacturing costs. Presently, air conditioning systems include the evaporator blower assembly and a separate accumulator enclosed in an accumulator housing. The accumulator is connected to the evaporator through a fluid flow line and connector joints. The evaporator and accumulator require separate mounting parts as well as the additional labor costs of separate manufacture and assembly.

An example of a prior art refrigerant system is disclosed in the U.S. Pat. No. 2,137,260 to Boles, issued Nov. 22, 1938 and assigned to the assignee of the present application. It is common to construct the heat exchange components of such a system from a stack of plates forming successively arranged flow chambers. An example of a stacked heat exchanger is disclosed in the U.S. Pat. No. 3,240,268 to Armes, issued Mar. 15, 1966 and assigned to the assigne of the present invention.

It is the object of the present invention to overcome the difficulties of the prior art air conditioner assemblies including separate evaporator and accumulator components.

More particularly, it is an object of the present invention to decrease the thermal loss inherent in present day evaporator and accumulator components, decrease the overall space required by present day systems, and eliminate the amount of parts, materials and labor costs.

SUMMARY OF THE INVENTION

The present invention provides an evaporator assembly including an additional cup area adjacent to the core of the assembly for collecting vaporized refrigerant and separating vaporized refrigerant from unvaporized refrigerant.

In carrying out the invention, the evaporator assembly includes a housing having a fluid inlet and a fluid outlet. A heat exchanger core is in direct fluid communication with the fluid inlet for interchanging heat between refrigerant entering and leaving the core. An accumulator chamber is within the housing in direct fluid communication with the fluid outlet and the heat exchange core for collecting vaporized and unvaporized refrigerant directly from the heat exchange core and about said fluid outlet.

The assembly provides two stages of vaporization which insure a high quality vapor state of the refrigerant entering the accumulator chamber directly from the heat exchange core.

The combination of the heat exchange core and accumulator chamber eliminates the fluid lines between prior art evaporator and accumulator components, eliminates assembly parts, and decreases labor assembly costs.

FIGURES IN THE DRAWINGS

Other advantages of the present invention will be readily appreciated as the same becomes completely understood by reference to the following detailed description when considered in connection with the accompanying drawings wherein.

DETAILED DESCRIPTION OF THE DRAWINGS

Figure 1:
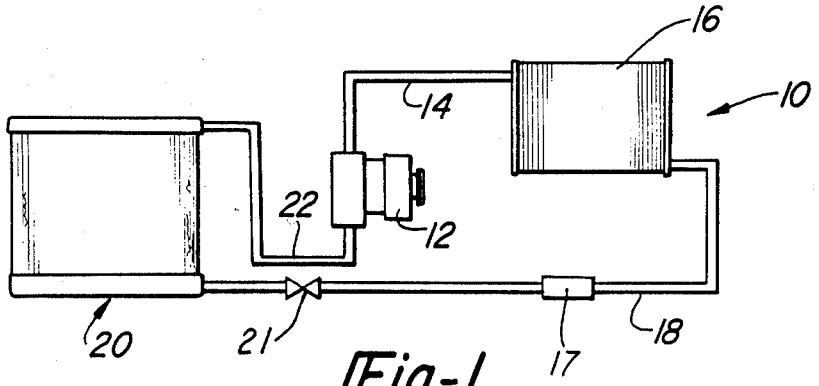
FIG. 1 is a schematic representation of an air conditioner system constructed in accordance with the present invention.
Figure 2:
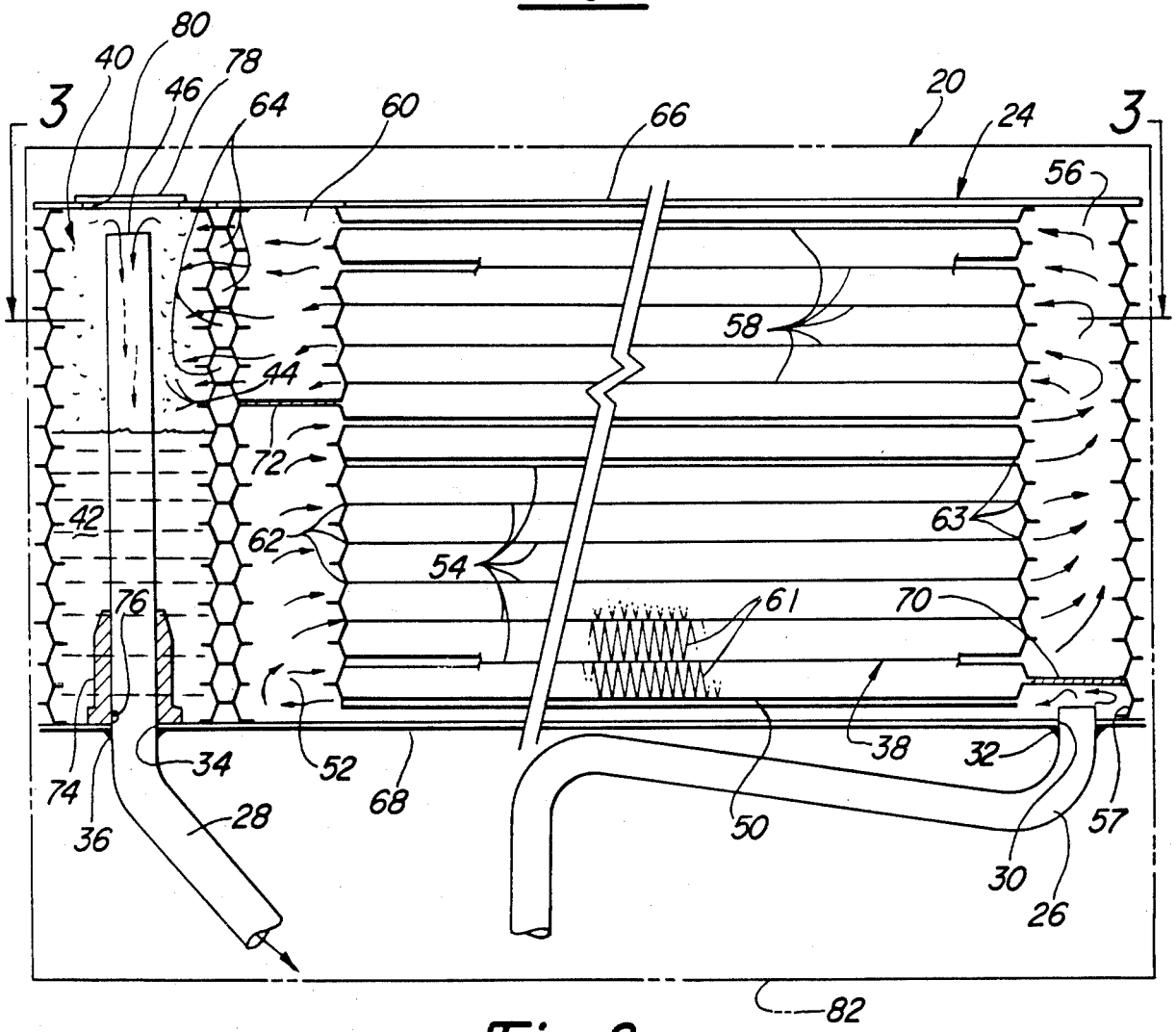
FIG. 2 is a cross-sectional elevational view of an evaporator assembly constructed in accordance with the present invention.

An air conditioner system including an evaporator assembly constructed in accordance with the present invention is generally shown at 10 in FIG. 1. The system illustrates the major components of an air conditioning system as would be found in passenger cars, vans, and trucks.

The system 10 includes a compressor 12 connected by a high pressure, high temperature discharge line 14 carrying refrigerant to a condenser 16. The compressor 12 pumps refrigerant vapor as required. The condenser 16 changes refrigerant vapor to a liquid by removal of heat. A liquid flow line 18 carries the liquid refrigerant from the condenser 16 through an inline filter and drier 17 to an integral evaporator and accumulator assembly generally indicated at 20 and also termed here an evapo-lator. refrigerant enters the evapo-lator assembly 20 as a low pressure mixture of liquid and vapor after passing through an expansion device 21 located in flow line 18. The evapo-lator assembly 20 exchanges heat between ambient air passing through the evapo-lator assembly 20 and the refrigerant thereby cooling the passing air and vaporizing the refrigerant. The vaporized refrigerant is carried through a low pressure, low temperature suction line 22 from th evapo-lator assembly 20 to the compressor 12.

The refrigerant used in this system can be dichlorodifluoromethane, commonly known as refrigerant 12 and marketed under trade names such as Freon-12, Genetron-12, Isotron-12 and Ucon-12.

The evapo-lator assembly 20 includes a housing generally indicated at 24. The housing 24 includes a fluid inlet 26 and a fluid outlet 28. Fluid inlet 26 receives the liquid vapor mixture after passing through the expansion device from the condenser 16. Inlet 26 is in the form of a tube 26 which enters the housing 24 through an opening 30. The tube 26 is connected to the housing 24 by welds 32. The fluid outlet 28 is in the form of an upstanding outlet tube 28. The outlet tube 28 extends through an opening 34 in the housing 20 and is connected to the housing 24 by welds 36. Tubes 26, 28 are connected to fluid lines 18, 22, respectively, by suitable connectors common in the art.

The evapo-lator assembly 20 includes a heat exchange core generally indicated at 38 in direct fluid communication with the fluid inlet 26 for interchanging heat between refrigerant entering and leaving the core 38. An accumulator chamber generally indicated at 40 within the housing 24 is in direct fluid communication with the fluid outlet 28 and the heat exchange core 38 for collecting vaporized and unvaporized refrigerant directly from the heat exchange core and for providing an environment of vaporized refrigerant about the fluid outlet. The invention provides an additional cup-shaped area defining the accumulator chamber 40 adjacent to the heat exchange core 38. The accumulator chamber 40 stores liquid refrigerant 42 and collects vaporized refrigerant indicated as speckled dots 44. The outlet opening 46 of the outlet tube 28 is within the accumulator chamber 40 such that it is in an environment of vaporized refrigerant.

Since the accumulator chamber 40 is in direct communication with the heat exchange core 38, it is essential that the refrigerant passing through the heat exchange core 38 is vaporized to a high degree. To accomplish this goal of creating what is termed "high quality vapor", the assembly includes first and second vaporizing means for vaporizing refrigerant entering the fluid inlet 26 into a high quality vapor of low liquid content prior to the vapor entering the accumulator chamber 40.

Specifically, the first vaporizing means includes a plurality of successively arranged and stacked flow chambers within the heat exchange core 38. A first flow chamber 50 provides a path for refrigerant entering the heat exchange core 38 from the fluid inlet 26 to a first header chamber 52. The fluid then passes through the heat exchange core 38 through a second series of flow chambers 54 to a second header chamber 56. The refrigerant fluid then passes through a third series of flow chambers 58 into a third header chamber 60. This three pass or S-curve flow path comprises the first vaporizing means of the assembly.

Each flow chamber 50, 54, 58 sandwiches ambient air passageways 61. Each flow chamber 50, 54, 58 has open ends 62, 63, the header chambers 52, 56, 60 enclosing the open ends 62, 63. Th header chambers 52, 56, 60 define expanded fluid communicating chamber between the open ends 62, 63. The combination of the flow chambers 50, 54, 58 with the header chambers 52, 56, 60 comprise the that exchange core.

The second vaporizing means includes a plurality of passageways 64 which provide fluid communication between the third header chamber 60 and the accumulator chamber 40. Vaporization is effected in the first vaporizing means through the combination of heat exchange as refrigerant passes through the flow chambers 50, 54, 58 and by the passage of fluid through the comparatively restricted openings 62, 63 into the header passageways 52, 56, 60. The second vaporizing means effects vaporization by the passage of the already substantially vaporized refrigerant through the comparatively constricted passageway 64 from the header chamber 60 into the accumulator chamber 40.

The housing 24 includes a top wall 66 and a bottom wall 68. The fluid inlet 26 opens into the first flow chamber 50 through the opening 30 in the bottom wall 68. A wall 70 extends across the bottom of the header chamber 56 thereby defining an entrance chamber 57 of the fluid flow chamber 50 adjacent the inlet 26. A second wall 72 divides the header chambers 52 and 60 thereby directing refrigerant flow from flow chamber 50 into the series of flow chambers 54. The first wall 70 prevents back flow in the header chamber 56 from flowing into the inlet 26 and entrance chamber 57 thereby directing fluid flow into the third series of stacked flow chambers 58. The third header chamber 60 is defined by the space betwen the second wall 72 and housing top 66. The walls 70, 72 provide closings within each of the headers at each end of the flow chambers 50, 54, 58 thereby defining the header chambers 52, 56, 60.

Figure 3:
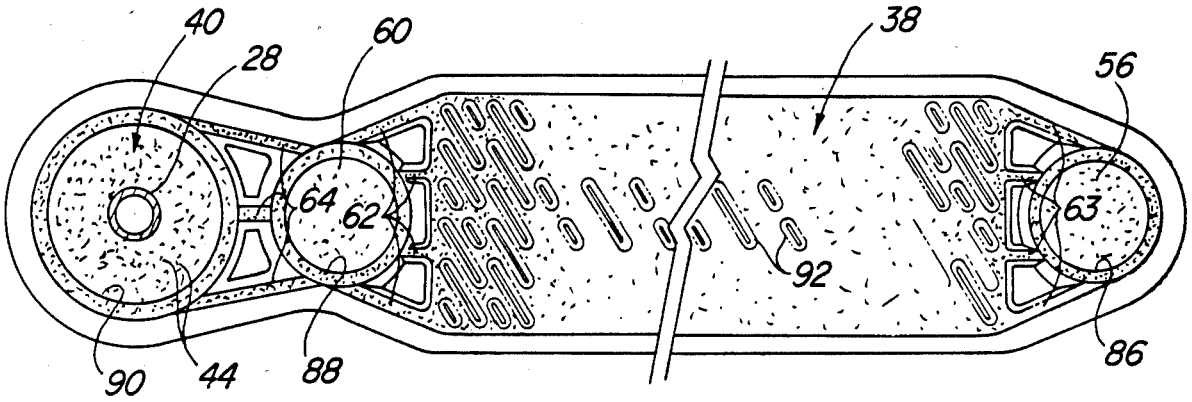
FIG. 3 is a cross sectional view taken substantially along lines 3—3 of FIG. 2.

The passageways 64 comprise a series of vertically stacked passageways 64 between the header chamber 60 above the second wall 72 and the accumulator chamber 40. Each of the series of passageways 64 includes a plurality of horizontally aligned passageways 64, as shown in FIG. 3. The fluid outlet tube 28 extends from the bottom wall 68 upwardly to a level above the second wall 72 and preferably approximate to the top 66 of the housing 24. At this level, the opening 46 into the outlet tube 28 is substantially level with the uppermost horizontal series of stacked passageways 64, the accumulator chamber 40 thereby defining a liquid refrigerant container for the liquid refrigerant 42 below the level of the second wall 72. This structure provides for a closed cup-shaped container for the liquid refrigerant 42 below the level of the passageways 64. The inlet 46, being substantially level with the highest series of passageways 64, is in an environment within the accumulator chamber 40 consisting essentially of high quality vaporized refrigerant. Because of the environment of high quality vaporized refrigerant, the necessity of a cone disposed over the vapor outlet, as in prior art accumulators, is obviated. The cones in prior art assemblies were necessary to prevent the entrance of liquid into the outlet tube. In the present invention, the combination of the accumulator and evaporator assemblies having a two stage vaporization provides sufficiently high quality refrigerant vapor so as to obviate the need for the cone.

The adjoining of the accumulator chamber 40 to the heat exchange core 38 through passageway 64 minimizes the travel path of the vaporized refrigerant from the heat exchange core 38 to the accumulator chamber 40. This construction minimizes the pressure drop and thermal loss between these two elements of the system 10. Unlike prior art systems wherein the vapor traveled through a fluid tube from the heat exchange core to the accumulator component, sometimes traveling over significant distances through an engine compartment, the present invention provides a minimum pressure drop and thermal loss between these combined components.

A filter screen 74 is disposed about the lower periphery of the outlet tube 28 for allowing the passage of fluid through oil bleed hole 76.

A plug 78 is connected to the housing top 66 over an opening 80 above the accumulator chamber 40. The opening 80 allows for core drainage during the manufacture of the assembly. The opening further allows for placement of the filter screen 74 during manufacture.

The housing 24 is contained within a plastic evaporator assembly casing schematically shown by hatched lines 82. Accordingly, the accumulator chamber 40 as well as the heat exchamger 38 are in the air flow path thereby providing more efficient heat exchange throughout the assembly.

Figure 4:
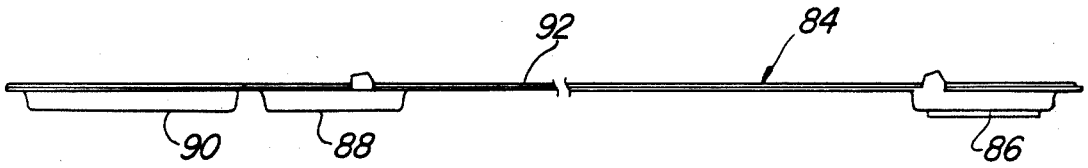
FIG. 4 is a side elevational view of a single plate which in combination with similar plates stacked thereon comprise the evaporator assembly housing.

The housing 24 includes a stack of plates, one of the plates being generally indicated at 84 in FIG. 4. Each plate includes a first opening 86 at one end and second and third openings 88, 90, respectively, at the other end. Corrugations 92 extend lengthwise between the first and second openings. Each of the plates 84 have its corrugations extending transverse to and being in contact with the corrugations of an adjacent plate and its periphery joined to the periphery of the adjacent plate to form one series of the stacked flow chambers 50, 54, 58. The first openings 86 are aligned to form the second header passageway 56 and entrance chamber 57 which interconnect the fluid inlet 26 to the first flow chamber 50. The second openings are aligned to form the first header chamber 52 and third header chamber 60. The third openings 90 are aligned to form the accumulator chamber 40. In one plate, the first opening is closed to define the first wall 70. In another plate, the second opening is closed thereby defining the second wall 72. The passageways 62, 63, 64 are defined by embossed portions of the plates between the several openings 86, 88, 90 and the corrugations 92. The top series of plates include embosses defining the passageways 64 between the third header chamber 60 and the accumulator chamber 40. The lower series of plates do not include these embosses so that there are no passageways between the first header chamber 52 and the accumulator chamber 40. Thusly, the lower portion of the accumulator chamber 40 is essentially a cup for containing the liquid refrigerant 42.

Figure 5:
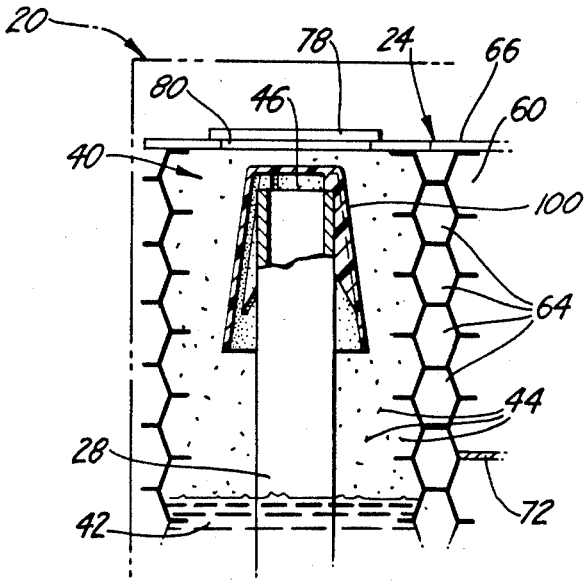
FIG. 5 is a side elevation view of the upper end of the outlet tube in FIG. 2 with a baffle mounted theron.

In operation, liquid/vapor mixture of refrigerant enters the fluid inlet 26 from an orifice tube and traverses the heat exchange core 38 in a first pass through a lower flow chamber 50, then traverses again through approximately seven tubes 54 in a second pass and again in the last pass through approximately the five tubes 58. Upon entering the third header chamber 60, most of the refrigerant is present as vapor after passing through the first stage vaporization. This last pass is connected to the accumulator chamber 40 by the series of passageways 64 thereby providing the second stage vaporization which further insures the vapor state and substantially eliminates the need for a separator cone over the fluid outlet tube 28. However, it will also be understood that for further insurance, a baffle 100 of the type disclosed in U.S. Pat. No. 4,111,005 which is hereby incorporated by reference could be added directly to the outlet tube 28 as shown in FIG. 5. The baffle 100 is slidably mounted on the upper end of the outlet tube and extends over the outlet opening 46 to direct any liquid refrigerant away from same while permitting access thereto of the vaporous refrigerant. Furthermore, the entry to the accumulator chamber 40 at a plurality of levels, minimizes the necessity of high quality vapor since the majority of passageways are well below the outlet opening 46.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims the invention may be practiced otherwise than as specifically described.

The embodiments of the invention in which an exclusive property or privilege is claimed are defined as follows:

1. An integral evaporator and accumulator assembly comprising: a housing including a fluid inlet and a fluid outlet; a heat exchange core in direct fluid communication with said fluid inlet for interchanging heat between refrigerant and a fluid passing over said core; and accumulator chamber within said housing in direct fluid communication with said fluid outlet and said heat exchange core for collecting vaporized and unvaporized refrigerant directly from said heat exchange core and for providing an environment of vaporized refrigerant about said fluid outlet, said housing including a stack of plates having a first opening at one end and second and third openings at a second end and corrugations extending traverse to and being in contact with the corrugations in an adjacent plate and its periphery joined to the periphery of said adjacent plate to form one series of said stacked flow chambers, said first openings being aligned to form a first header, said second openings being aligned to form a second header and said third openings being aligned to form said accumulator chamber, one of said plates having a first opening closed to define a first closing in said first header, one of said plates having said second opening closed to define a second closing in said second header, and several of said top plates including embossments extending between said second and third openings and between said first and second openings and said corrugations to define said passageways to and from said headers and flow chambers and said accumulator chamber, said lower plates including embosses extending from said first and second openings to said corrugations defining passageways for fluid flow in said lower stacked plates only between said headers and said flow chambers, said fluid outlet in the form of an upstanding outlet tube projecting upwardly from said bottom wall in said accumulator chamber, said outlet tube having an outlet opening at its upper end located adjacent a top wall of said housing in said accumulator chamber, baffle means mounted on said upper end of said outlet tube over said outlet opening for deflecting liquid refrigerant away from said outlet opening while permitting access thereto of vaporous refrigerant.

* * * * *